US010668613B2

(12) United States Patent
Ogle et al.

(10) Patent No.: US 10,668,613 B2
(45) Date of Patent: Jun. 2, 2020

(54) SLIDE SWITCH FOR A POWER TOOL

(71) Applicants: Robert Bosch Tool Corporation, Broadview, IL (US); Robert Bosch GmbH, Stuttgart (DE)

(72) Inventors: Stuart Ogle, Western Springs, IL (US); Hsiu-Kai Liao, Palatine, IL (US)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 1010 days.

(21) Appl. No.: 14/774,810

(22) PCT Filed: Mar. 12, 2014

(86) PCT No.: PCT/US2014/024923

§ 371 (c)(1),
(2) Date: Sep. 11, 2015

(87) PCT Pub. No.: WO2014/159734

PCT Pub. Date: Oct. 2, 2014

(65) Prior Publication Data

US 2016/0046011 A1 Feb. 18, 2016

Related U.S. Application Data

(60) Provisional application No. 61/781,262, filed on Mar. 14, 2013.

(51) Int. Cl.
*B25F 5/00* (2006.01)
*B24B 23/02* (2006.01)

(52) U.S. Cl.
CPC ..... *B25F 5/001* (2013.01); *B24B 23/02* (2013.01); *B25F 5/00* (2013.01)

(58) Field of Classification Search
CPC ..... B25F 5/001; B24B 23/022; B24B 23/02
(Continued)

(56) References Cited

U.S. PATENT DOCUMENTS 3,328,613 A * 6/1967 Gawron ..... H01H 9/061 310/48
3,415,966 A * 12/1968 Matthews ..... H01H 1/18 200/522

(Continued)

FOREIGN PATENT DOCUMENTS

DE 102009027688 A1 7/2010
EP 2030710 A2 3/2009

(Continued)

OTHER PUBLICATIONS

International Search Report corresponding to PCT Application No. PCT/US2014/024923, dated Aug. 8, 2014 (3 pages).

(Continued)

*Primary Examiner* — Robert F Long
(74) *Attorney, Agent, or Firm* — Maginot, Moore & Beck LLP

(57) ABSTRACT

A power tool includes a slide switch which is configured to provide variable speed control of the rotational velocity of a drive member as well as provide ON/OFF functionality for the tool 10 based on the position of the switch. The slide switch eliminates the need for a separate switch for turning the tool on and off.

18 Claims, 4 Drawing Sheets

(58) Field of Classification Search
USPC ..... 173/2, 217
See application file for complete search history.

(56) References Cited

U.S. PATENT DOCUMENTS

| | | | | |
|---|---|---|---|---|
| 3,484,632 | A * | 12/1969 | Opalenik | H01H 9/061 310/68 R |
| 4,286,125 | A * | 8/1981 | Schaffeler | H01H 15/102 200/522 |
| 4,592,144 | A * | 6/1986 | Tolbert | B23D 49/167 200/291 |
| 5,453,728 | A | 9/1995 | Zimmermann et al. | |
| 6,086,502 | A * | 7/2000 | Chung | B25F 5/001 475/299 |
| 6,186,709 | B1 * | 2/2001 | Hsu | B25F 5/001 200/318.2 |
| 6,269,888 | B1 | 8/2001 | Schuda et al. | |
| 6,380,502 | B1 * | 4/2002 | Hirschburger | H01H 9/061 200/16 D |
| 6,655,470 | B1 * | 12/2003 | Chen | B25B 17/00 173/216 |
| 6,742,601 | B2 * | 6/2004 | Numata | B24B 23/028 173/170 |
| 7,021,400 | B2 * | 4/2006 | Oretti | B23B 31/123 173/176 |
| 7,044,882 | B2 * | 5/2006 | Eisenhardt | B23B 45/008 475/298 |
| 7,497,272 | B2 * | 3/2009 | Strasser | B25D 16/006 173/4 |
| 8,074,735 | B2 * | 12/2011 | Aeberhard | B25B 21/00 173/104 |
| 2003/0133239 | A1 * | 7/2003 | Feil | H02H 11/00 361/72 |
| 2005/0262984 | A1 * | 12/2005 | Hetcher | B23D 45/044 83/471.3 |
| 2006/0255754 | A1 | 11/2006 | Rudolf et al. | |
| 2009/0003950 | A1 * | 1/2009 | Mok | B23B 31/123 408/240 |
| 2009/0211886 | A1 * | 8/2009 | Aoki | H01H 9/063 200/252 |
| 2011/0057584 | A1 | 3/2011 | Nishikimi | |
| 2011/0147021 | A1 * | 6/2011 | Schaal | B25D 16/00 173/47 |
| 2012/0024552 | A1 | 2/2012 | Kawano et al. | |
| 2014/0069676 | A1 * | 3/2014 | Abante | B25F 5/001 173/217 |

FOREIGN PATENT DOCUMENTS

| | | | |
|---|---|---|---|
| EP | 2039479 | A1 | 3/2009 |
| EP | 2572832 | A1 | 3/2013 |
| JP | 2012000726 | A | 1/2012 |
| WO | 2007056172 | A1 | 5/2007 |

OTHER PUBLICATIONS

Examination Report corresponding to European Patent Application No. 14 774 841.2 (4 pages).

* cited by examiner

SLIDE SWITCH FOR A POWER TOOL

CROSS-REFERENCE TO RELATED APPLICATIONS

This application is a 35 U.S.C. § 371 National Stage Application of PCT/US2014/024923, filed Mar. 12, 2014, which claims the benefit of priority to U.S. Provisional Application Ser. No. 61/781,262 entitled "SLIDE SWITCH FOR A POWER TOOL" by Ogle et al., filed Mar. 14, 2013, the disclosures of which are incorporated herein by reference in their its entirety.

TECHNICAL FIELD

The present invention relates to power tools and in particular to mechanisms for controlling the speed of a rotary power tool output shaft.

BACKGROUND

In general, rotary power tools are light-weight, handheld power tools capable of being equipped with a variety of tool accessories and attachments, such as cutting blades, sanding discs, grinding tools, and many others. These types of tools typically include a generally cylindrically-shaped main body that serves as an enclosure for an electric motor as well as a hand grip for the tool. The electric motor is operably coupled to a drive member that extends from the nose of the housing. The electric motor is configured to turn the drive member at relatively high rotational velocities. The drive member includes a tool holder that is configured to retain various accessory tools so they are driven to rotate along with the drive member.

Rotary power tools are often configured for variable speed operation. Slide switches have been used to provide variable speed control in rotary power tools. Typically, the slide switch is located near the cord end of the tool and is movable in a circumferential direction between a minimum and a maximum speed position. The slide switch has a switch lever that generally follows the curvature of the cylindrical configuration of the housing. While effective for variable speed control of the tool, multiple "swipes" of the dial are required to cover the entire speed range of the tool.

In addition, a separate power switch is often required for turning the tool on and off. These power switches are typically connected between the power source of the tool and the controller as well as the motor. As a result, there is typically a high current draw through the switch when the switch is turned on. A mechanical switch with contact points are typically required to handle this current.

DRAWINGS

Figures 5A, 5B, 5C:
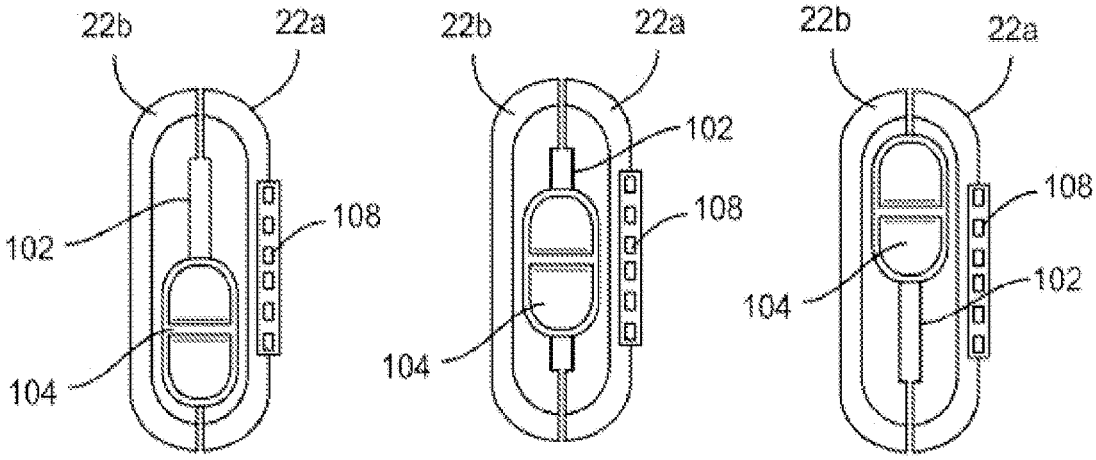

FIGS. 5A, 5B, and 5C depict the switch knob of the slide switch in the OFF position, an ON/mid-speed position, and an ON/Maximum speed position, respectively.

Figure 1:
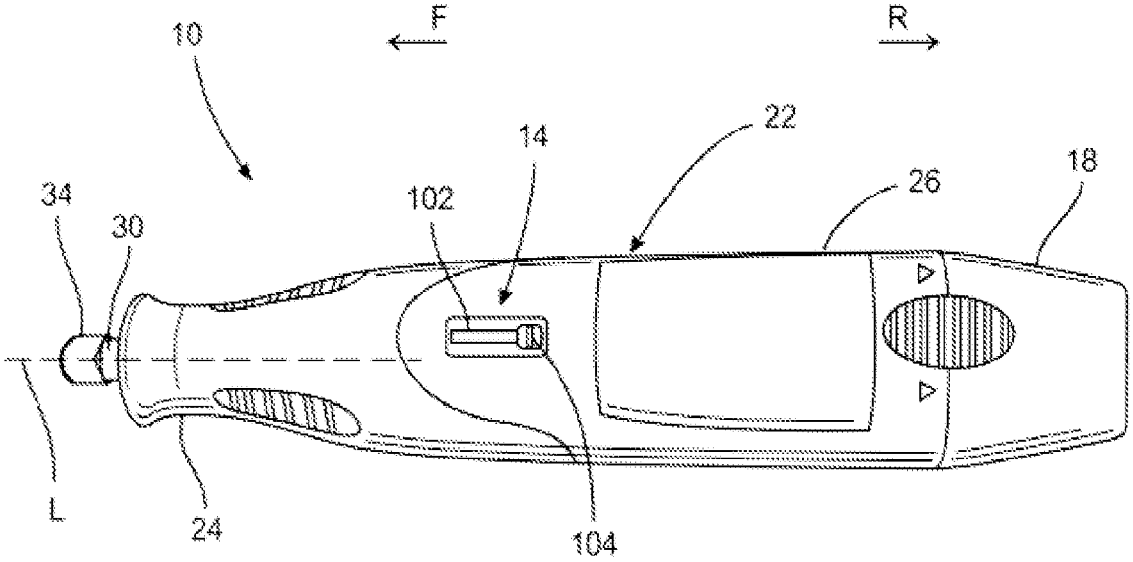
FIG. 1 is a perspective view of rotary power tool including a slide switch in accordance with the present disclosure.
Figure 6:
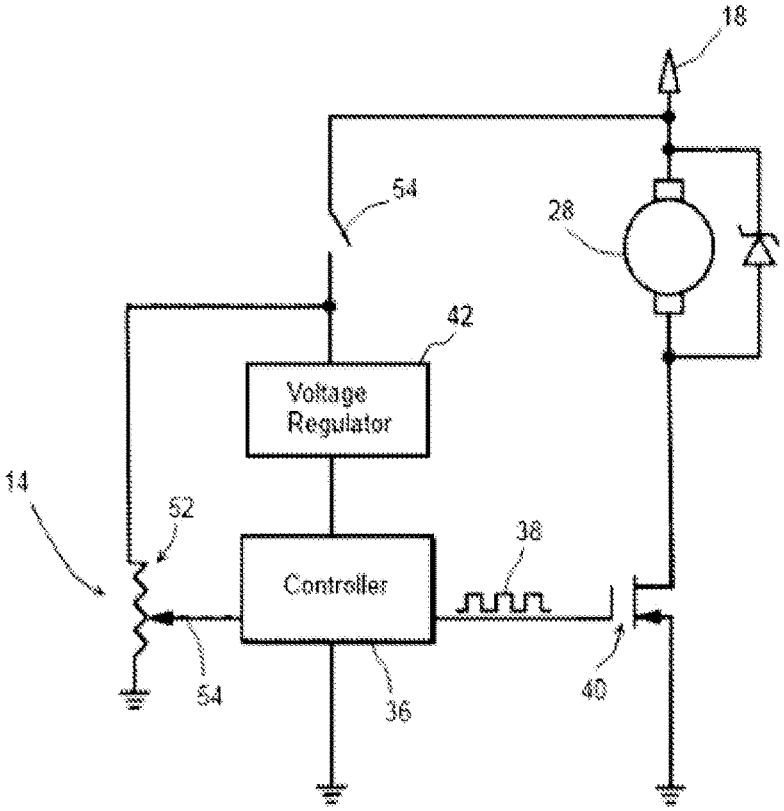

FIG. 6 is a circuit diagram of the variable speed and power circuits of the rotary power tool of FIG. 1.

Figure 2:
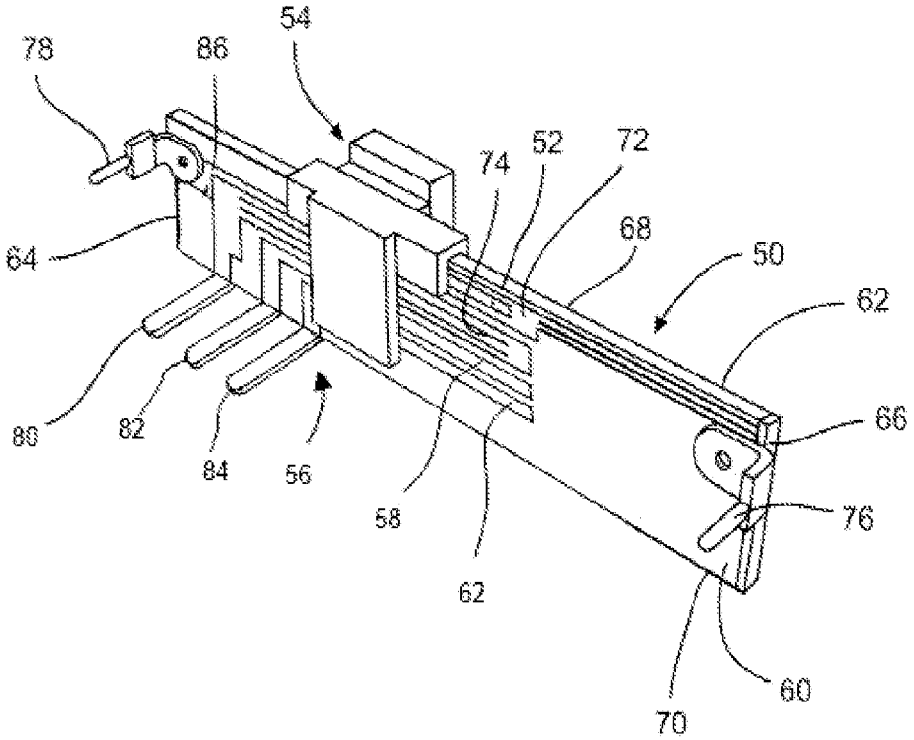
FIG. 2 is a perspective view of the slide switch assembly of the rotary power tool of FIG. 1.
Figure 7:
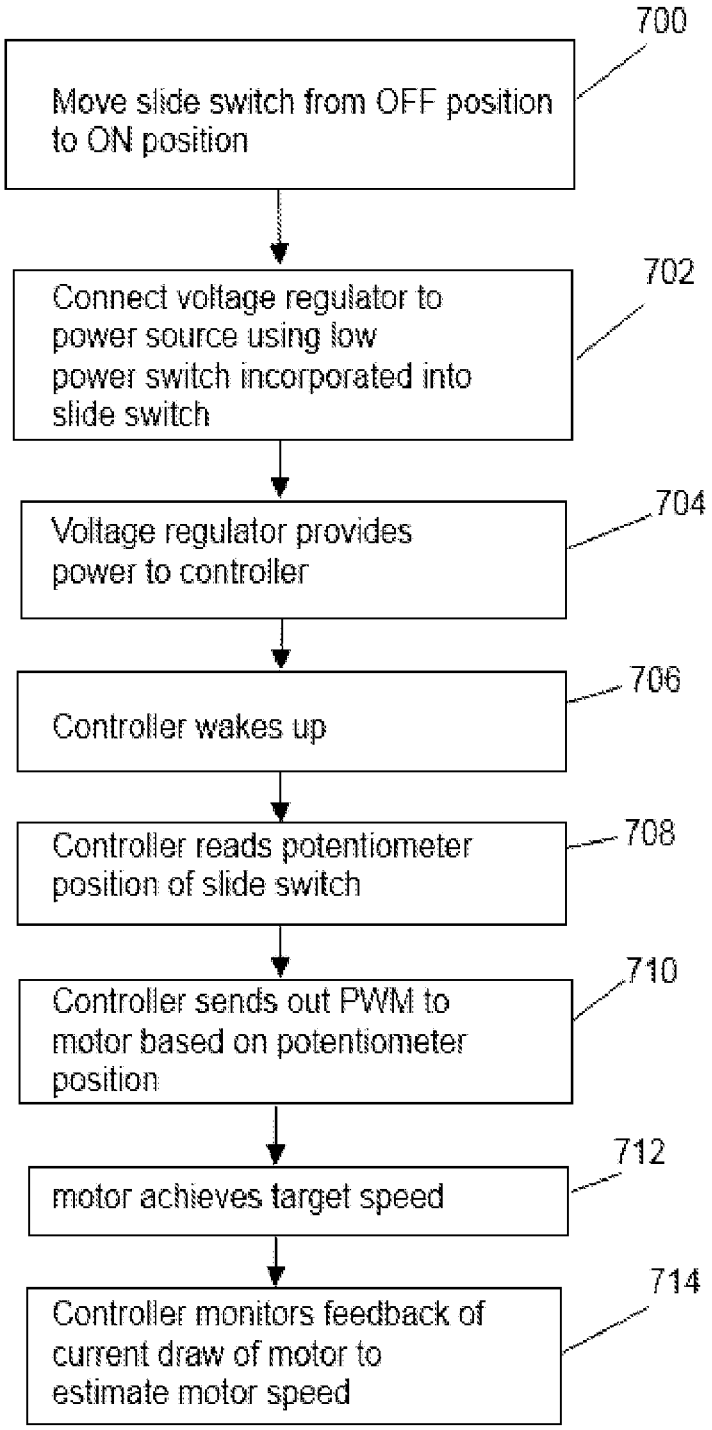

FIG. 7 depicts a flowchart of a process for operating the power tool using the slide switch assembly of FIG. 2.

DESCRIPTION

For the purposes of promoting an understanding of the principles of the invention, reference will now be made to the embodiments illustrated in the drawings and described in the following written specification. It is understood that no limitation to the scope of the disclosure is thereby intended. It is further understood that the disclosure includes any alterations and modifications to the illustrated embodiments and includes further applications of the principles of the disclosure as would normally occur to one of ordinary skill in the art to which this disclosure pertains.

In accordance with one embodiment, a power tool includes a housing defining a longitudinal axis and having a nose portion. A variable speed motor is enclosed within the housing and includes an output member that extends from the nose portion of the housing parallel to the longitudinal axis. The variable speed motor is configured to receive a speed control signal and to drive the output member at different drive speeds depending on a parameter of the speed control signal. A speed signal generator is configured to generate the speed control signal. A power circuit connects the speed signal generator to a power source. A slide switch on the housing is slidable between a first position and a second position in relation to the housing. The slide switch is configured to output a variable selection signal having a value that depends on a location of the slide switch in relation to the first and the second positions. The speed signal generator is coupled to receive the selection signal from the slide switch and to generate the speed control signal such that the parameter of the speed control signal depends on the value of the selection signal. In addition, when the slide switch is in the first position, the slide switch opens the power circuit and cuts off power to the motor, and, when the slide switch is moved from the first position toward the second position, the power circuit is closed and power is supplied to the motor.

In another embodiment, a method of operating a power tool is provided. The method comprises manually moving a slide switch of the power tool from a first position toward a second position. Power is connected to a speed signal generator via a first circuit of the slide switch when the slide switch moves away from the first position. A speed selection signal is output to the speed signal generator via a second circuit of the slide switch. The second circuit outputs the speed selection signal with a value dependent upon a position of the slide switch in relation to the first and the second positions. The speed control signal is generated such that the parameter of the speed control signal depends on the value of the selection signal using the speed signal generator.

Referring now to FIG. 1, an embodiment of a power tool 10 including a slide switch 14 is depicted. The slide switch 14 is configured to provide variable speed control of the rotational velocity of the drive member as well as provide ON/OFF functionality for the tool 10 based on the position of the switch. The slide switch 14 eliminates the need for a separate switch for turning the tool 10 on and off. In addition, the linear slide switch 14 has a linear path of motion that is aligned with the longitudinal axis L of the tool 10 which allows users to turn the tool 10 from OFF to maximum speed and vice versa in one smooth motion. In alternative embodiments, the slide switch may be provided with paths of motion that are transverse or perpendicular to the longitudinal axis L of the tool 10.

With continuing reference to FIG. 1, the rotary power tool 10 includes a generally cylindrically shaped housing 22 constructed of a rigid material such as plastic, metal, or composite materials such as a fiber reinforced polymer. The housing 22 defines a longitudinal axis L and includes a nose portion 24 and a handle portion 26. The handle portion 26 encloses a motor 28 (FIG. 6). In one embodiment, the motor 28 comprises an electric motor configured to receive power from a rechargeable battery 18 connected at the base of the handle portion 26. In other embodiments, electric power for the motor may be received from an AC outlet via a power cord (not shown).

The motor 28 is coupled to a drive member 30 that extends from the nose portion 24 of the housing in coaxial alignment with the longitudinal axis L. The drive member 30 includes a tool holder 34 that is configured to releasably retain various accessory tools (not shown), such as grinding wheels and cutting discs, exterior to the nose portion 24 of the housing 22. As the tool holder 34 is rotated by the drive member 30, an accessory tool is driven to rotate about the axis L of the drive member 30. In one embodiment, the tool holder 34 comprises a chuck or collet that is configured to clamp onto the shank of an accessory tool. In alternative embodiments, the tool holder 34 and accessory tools may be provided with interlocking drive structures (not shown) that mate to secure the accessory tool to the tool holder 34.

Referring to FIG. 6, the motor 28 comprises a variable speed motor that is configured to rotate the drive member 30 about the axis L at high frequencies, e.g., 5,000 to 30,000 rotations per minute. Power to the motor 28 and the rotational speed of the motor 28 is controlled by the linear slide switch 14. The switch 14 is provided on the handle portion 26 of the housing 22 with the path of movement of the switch aligned with the longitudinal axis L of the housing 22.

The operating speed of the motor 28 is controlled by a speed control signal 38 sent to the motor by a controller 36. In one embodiment, the controller includes oscillator or similar type of structure configured to generate a pulse width modulated (PWM) output signal 38. The PWM signal 38 is used to open and close a transistor such as MOSFET 40 that controls the flow of current to the motor 28 from the power source 18. The operating speed of the motor 28 depends on the duty cycle of the pulsed output 38. The duty cycle of the pulsed output 38 in turn is controlled by a speed selection signal output by the slide switch. The speed selection signal has a value that is dependent upon on the position of the slide switch 14. The controller 36 is configured to determine the value of the speed selection signal and to generate a PWM signal 38 having a duty cycle that corresponds to that value.

The controller 36 is configured to receive power from a voltage regulator 42. The voltage regulator 42 is operably connected to receive power from the power source 18 and to output a regulated voltage to the controller, e.g., 3 V DC, that the controller 36 can use to generate the PWM signal 38. The slide switch 14 is configured to provide ON/OFF functionality for the power tool 10 by controlling power to the voltage regulator 42. Because the power necessary to operate the voltage regulator is relatively small, a low power switch is possible which can be implemented in an easier and more cost effective manner, e.g., using conductive traces provided on the switch body, and does not require a separate mechanical switching mechanism and contact to handle the higher power requirements and high current draw between the motor and power source 18.

Referring now to FIG. 2, the slide switch 14 includes a switch body 50 that supports a slide potentiometer 52, a lower power switch 56, and an actuator 54. The switch body 50 comprises a planar member, such as a substrate or plate, formed of a non-conductive material and/or insulative material, such as plastic, FR4, and in one embodiment comprises a printed circuit board. As depicted in FIG. 2, the switch body 50 has a generally rectangular shape with opposing main surfaces, i.e., a first main surface 60 and a second main surface 61. The rectangular switch body 50 also includes a first short edge portion 64, a second short edge portion 66, a first long edge portion 68, and a second long edge portion 70.

Figure 3:
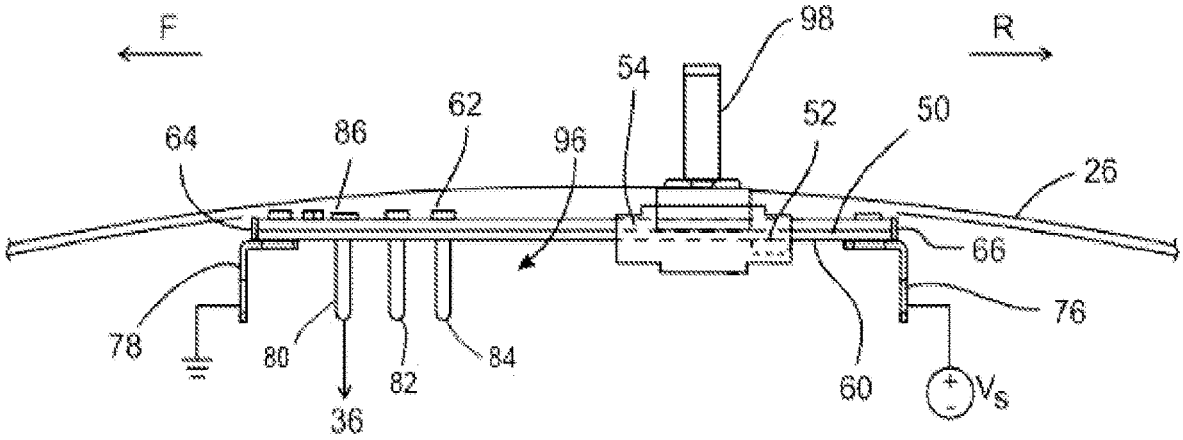
FIG. 3 is a side elevational view of the slide switch assembly of FIG. 2 with the slider in the ON position.
Figure 4:
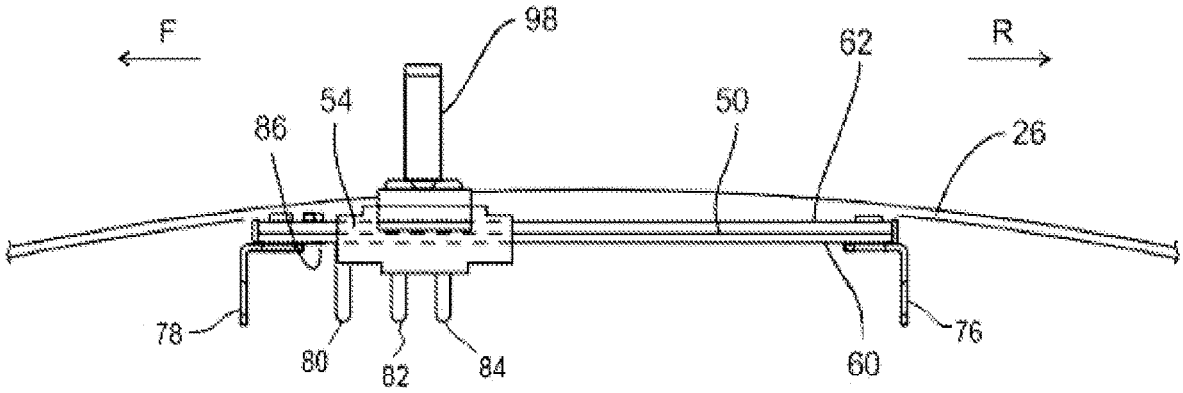
FIG. 4 is a side elevational view of the slide switch assembly of FIG. 2 with the slider in the OFF position.

Referring to FIGS. 3 and 4, the switch body 50 is attached to the handle portion 26 of the housing 22 with the second main surface 61 facing away from the interior of the housing 22 and the first main surface 60 facing inwardly toward the interior of the housing 22. The switch body 50 is positioned with the first short edge portion 64, referred to hereafter as the leading edge portion, oriented in the forward direction F toward the nose portion 24 of the housing 22 and the second short edge portion 66, referred to hereafter as the trailing edge portion, oriented in the rearward direction R toward the base of the handle portion 26 of the housing 22.

The slide potentiometer 52 is provided on the switch body 50. The slide potentiometer includes a resistive strip 72, a conductive strip 74, and a first sliding contact (not visible). The resistive strip 72 comprises a generally rectangular strip of resistive material provided on the first main surface 60 of the switch body 50 extending between the leading edge portion 64 and trailing edge portion 66. The conductive strip 74 is arranged generally parallel to and spaced apart from the resistive strip 72 extending along a portion of the distance between the leading and trailing edge portions 64, 66 of the switch body 50.

The actuator 54 is formed of a non-conductive material, such as plastic, and is slidably mounted onto the switch body. As depicted in FIGS. 2-4, the actuator 54 is configured to wrap around the switch body 50 so that a portion of the actuator 54 is arranged on each side of the switch body. The first sliding contact (not shown) is mounted to the portion of the actuator 54 that faces the first main surface 60 and serves to electrically connect the resistive strip 72 to the conductive strip 74 as the actuator 54 slides along the switch body 50.

Wiring terminals 76, 78, 80, are attached to the switch body 50 for electrically coupling the resistive strip and conductive strip to speed control wiring 86. In one embodiment, terminal 76 electrically connects one end of the resistive strip 72 to ground and terminal 78 electrically connects the other end of the resistive strip 72 to a fixed input voltage Vs. The terminal 80 is electrically connected to an end of the conductive strip 74 to serve as the output terminal for the slide potentiometer 52. In one embodiment, the output voltage at the terminal is a function of the input voltage Vs and the position of the sliding contact 14 along the resistive strip 72.

The low power switch 56 may be implemented on the slide switch in a number of ways. FIG. 2 depicts one example of how the lower power switch 56 may be implemented and is not intended to be limiting in any way. In the embodiment of FIG. 2, the low power switch 56 includes a first conductive trace 58, a second conductive trace 62, and a second sliding contact (not shown). The first conductive trace 58 and the second conductive trace 62 are arranged substantially parallel to the each other on the first main surface 60 of the switch body 50 extending between the leading edge portion 64 and trailing edge portion 66. The first conductive trace 58 is electrically connected to a wiring terminal 82 provided on the switch body 50, and the second conductive trace 62 is electrically connected to a wiring terminal 84 provided on the switch body 50. The wiring terminals 82, 84 are in turn electrically connected between the voltage regulator 42 and the power source 18 (see, FIG. 6).

The actuator 54 is supported by the switch body 50 for sliding movement between a first position, e.g., a forwardmost position, (FIG. 4) proximate the leading edge portion 64 of the switch body 50 and a second position, e.g., rearwardmost position, (FIG. 3) proximate the trailing edge portion 66 of the switch body 50. In the embodiment of FIGS. 2-4, the forwardmost position (FIG. 4) of the actuator 54 corresponds to the ON/maximum speed position, and the rearwardmost position (FIG. 3) corresponds to the OFF position.

As can be seen in FIG. 2, the conductive strip 74 and the conductive traces 58, 62 do not extend all the way to the trailing edge portion 66. As a result, when the actuator 54 is moved to the rearmost position (FIG. 3), the first sliding contact (not shown) moves out of contact with the conductive strip 74. This causes the output of the potentiometer 52 at terminal 80 to be at ground potential indicating that the PWM signal 38 for the motor 28 should have a duty cycle of zero percent. In addition, the second sliding contact (not shown) moves out of contact with the conductive traces 58, 62 which opens the power circuit to the voltage regulator 42 which effectively cuts off power to the controller 36.

The slide switch 14 is mounted to the housing 22 of the tool 10 with the first main surface 60 facing inwardly toward the interior of the housing and the second main surface facing away from the interior of the housing. As depicted in FIGS. 3 and 4, a stem or post 98 extends from the portion of the actuator 54 located in front of the second main surface 61 of the switch body. The stem 98 extends through a slot 102 defined in the housing of the tool (FIGS. 1 and 5A-5C). In one embodiment, the slot 102 is defined along the interface between two housing shell portions 22*a*, 22*b* that are attached in a clamshell configuration (FIGS. 5A-5C).

The slot 102 in the housing provides clearance for the stem 98 to move the actuator 54 along its full path of movement between the ON/maximum position (FIG. 4) and the OFF position (FIG. 3). A switch knob or button 104 is attached to the stem 102 exterior to the housing to facilitate manipulation of the actuator by a user of the tool. Indicator markings 108 may be provided on the housing 22 alongside the slot 102 to identify the operating speeds that correspond to the switch positions.

FIG. 5A shows the switch knob 104 in the OFF position. FIG. 5B shows the switch knob 104 in an ON/intermediate speed position. FIG. 5C shows the switch knob 104 in the ON/maximum speed position. The slide switch 14 is mounted to the tool 10 with the path of movement of the actuator 54 aligned with the longitudinal axis L. This arrangement allows the user to easily to move the switch knob 104 between the ON/maximum speed position (FIG. 5C) and the OFF position (FIG. 5A) and vice versa in one smooth motion.

Providing all of the circuit components of the switch on one side of the switch body and facing that side of the switch body toward the interior of the housing 22 helps to prevent contamination of the switch components by debris entering the housing. Although not depicted, a dust boot or dust cover mechanism may be provided to prevent or limit the chance of debris entering the housing through the slot 102.

FIG. 7 depicts a flowchart of a process for powering on the tool 10 using the slide switch 14. At block 700, the actuator 54 of the slide switch 14 is moved from the OFF position toward the On position. A sliding contact on the actuator then electrically connects the conductive traces 58, 62 and closes the power circuit between the power source 18 of the tool 10 and the voltage regulator 42 which powers on the voltage regulator 42 (block 702). The voltage regulator 42 supplies a regulated voltage, e.g., 3V DC, to the controller 36 which wakes the controller up 36 (block 704). The controller wakes up in response to receiving power from the voltage regulator (block 706). The controller then reads the output of the potentiometer of the slide switch (708) and sends a corresponding PWM signal 38 to the motor (block 710) so that the motor achieves the target speed (block 712). The controller may be configured to receive feedback of the motor current draw so that the controller can estimate the motor speed and make adjustments to the PWM signal 38 if necessary block 714).

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A power tool comprising:

a housing defining a longitudinal axis and having a nose portion;

a variable speed motor enclosed within the housing and including an output member that extends from the nose portion of the housing parallel to the longitudinal axis, the variable speed motor being configured to receive a speed control signal and to drive the output member at different drive speeds depending on a parameter of the speed control signal;

a speed signal generator configured to generate the speed control signal;

a power circuit that connects the speed signal generator to a power source; and a slide switch slidably supported on the housing and being operably connected to the power circuit, the slide switch being slidable between a first position and a second position in relation to the housing and being configured to output a variable selection signal having a value that depends on a location of the slide switch in relation to the first and the second positions, wherein the speed signal generator is coupled to receive the selection signal from the slide switch and to generate the speed control signal such that the parameter of the speed control signal depends on the value of the selection signal, wherein, when the slide switch is in the first position, the slide switch opens the power circuit and cuts off power to the speed signal generator, wherein, when the slide switch is moved from the first position toward the second position, the power circuit is closed and power is supplied to the speed signal generator.

2. The power tool of claim 1, wherein the slide switch includes:

a switch body including a plurality of conductors mounted thereon, the plurality of conductors defining a first circuit for connecting to the power circuit and a second circuit for providing the selection signal;

first terminals attached to the switch body which connect the first circuit to the power circuit;

second terminals attached to the switch body which connect the second circuit to the speed signal generator; and an actuator that is slidably supported on the switch body for movement between the first position and the second position, wherein, when the actuator is in the first position, the first circuit is opened which opens the power circuit and cuts off power to the speed signal generator, wherein, when the actuator is moved from the first position toward the second position, the first circuit is closed which closes the power circuit so that power is supplied to the speed signal generator, and wherein the value of the selection signal depends on a location of the actuator in relation to the switch body.

3. The power tool of claim 2, further comprising:

a voltage regulator coupled to the speed signal generator and configured to provide a regulated voltage to the speed signal generator, the speed signal generator being configured to generate the speed control signal using the regulated voltage, wherein the power circuit connects the voltage regulator to the power source, and wherein the first circuit is connected to the power circuit between the power source and the voltage regulator.

4. The power tool of claim 3, wherein the voltage regulator provides a regulated voltage of approximately 3V DC.

5. The power tool of claim 3, wherein the switch body comprises a substrate and the first circuit and the second circuit comprise conductive traces formed on the substrate.

6. The power tool of claim 3, wherein the conductive traces of the second circuit implement a slide potentiometer, the selection signal comprising an output of the potentiometer.

7. The power tool of claim 6, wherein the speed signal generator generates the speed control signal as a pulse width modulated signal having a duty cycle dependent upon the value of the selection signal.

8. The power tool of claim 7, wherein, when the actuator is at the first position, the selection signal output by the potentiometer causes the speed control signal to have a zero percent duty cycle.

9. The power tool of claim 2, wherein the housing is cylindrical about the longitudinal axis and is configured to serve as a handle for the power tool.

10. The power tool of claim 8, wherein the slide switch defines a linear path of movement between the first and the second positions, and wherein the slide switch is supported such that the path of movement is arranged parallel to the longitudinal axis.

11. A method of operating a power tool having a housing defining a longitudinal axis and that has a nose portion, a variable speed motor enclosed within the housing that includes an output member that extends from the nose portion of the housing parallel to the longitudinal axis, the variable speed motor being configured to drive the output member at different drive speeds depending on a parameter of a speed control signal, the method comprising:

manually moving a slide switch of the power tool from a first position toward a second position, the slide switch including a first circuit and a second circuit;

connecting power to a speed signal generator via the first circuit when the slide switch moves away from the first position;

outputting a speed selection signal to the speed signal generator via the second circuit, the second circuit outputting the speed selection signal with a value dependent upon a position of the slide switch in relation to the first and the second positions; and generating the speed control signal such that the parameter of the speed control signal depends on the value of the selection signal using the speed signal generator.

12. The method of claim 11, further comprising:

disconnecting the power from the speed signal generator when the slide switch is at the first position.

13. The method of claim 12, further comprising:

delivering power to a voltage regulator via the first circuit when the slide switch moves away from the first position, the voltage regulator being configured to provide a regulated voltage to the speed signal generator in response to receiving power, the speed signal generator being configured to generate the speed control signal using the regulated voltage; and disconnecting the power to the voltage regulator when the slide switch is at the first position such that the regulated voltage is not provided to the speed signal generator.

14. The method of claim 13, wherein the slide switch comprises:

a switch body, the first circuit and the second circuit being provided on the switch body; and an actuator slidably supported on the switch body for movement between the first position and the second position, wherein the actuator opens the first circuit such that power is disconnected from the voltage regulator when the actuator is at the first position, wherein the actuator closes the first circuit such that power is connected to the voltage regulator when the actuator is moved away from the first position.

15. The method of claim 14, wherein the regulated voltage is approximately 3V DC.

16. The method of claim 15, wherein the second circuit comprises a slide potentiometer which outputs the selection signal depending on the position of the actuator.

17. The method of claim 16, wherein the speed signal generator generates the speed control signal as a pulse width modulated signal having a duty cycle dependent upon the value of the selection signal.

18. The method of claim 17, wherein, when the actuator is at the first position, the selection signal output by the potentiometer causes the speed control signal to have a zero percent duty cycle.

* * * * *